US005368890A

United States Patent [19]

de Nagybaczon

[11] Patent Number: 5,368,890

[45] Date of Patent: Nov. 29, 1994

[54] "COATING PROCESS FOR DEPOSITING EXTREMELY HARD FILMS ON SUBSTRATES"

[76] Inventor: Erno N. de Nagybaczon, 75 East Sheen Avenue, London, England, SW14 8AX

[21] Appl. No.: 52,394

[22] Filed: Apr. 23, 1993

[30] Foreign Application Priority Data

Sep. 1, 1992 [GB] United Kingdom ..... 18477
Oct. 26, 1992 [GB] United Kingdom ..... 22419

[51] Int. Cl.[5] ..... B05D 1/12

[52] U.S. Cl. ..... 427/249; 427/11; 427/180; 427/194; 427/122; 423/446

[58] Field of Search ..... 427/11, 180, 194, 249, 427/122; 423/446; 156/DIG. 68

[56] References Cited

U.S. PATENT DOCUMENTS 4,159,352 6/1979 Martin ..... 427/11
4,358,506 11/1982 Intrater .
4,374,903 2/1983 Intrater .
4,376,806 3/1983 Intrater .
4,391,854 7/1983 Kanda et al. ..... 427/192
4,396,677 8/1983 Intrater .
4,426,423 6/1984 Intrater .
4,485,757 12/1984 Ebner ..... 427/180
4,699,808 10/1987 Menard et al. ..... 427/180
4,741,918 5/1988 de Nagybaczon .
4,925,701 5/1990 Jansen ..... 427/99
5,140,783 8/1992 Hoffman .

FOREIGN PATENT DOCUMENTS

85/0580 9/1986 OAPI .

OTHER PUBLICATIONS

*Production of Metallo Carbohedrines in the Solid State,* by S. F. Carter et al., "Science", vol. 260, p. 195, Apr. 9, 1993.

*Metastability of Superconducting Compounds in the Y-Ba-Cu-O System,* bt E. L. Brosha et al., "Science," vol. 260, pp. 196 et seq., Apr. 9, 1993.

*The Delamination Theory of Wear* by Nam P. Suh et al., Elsevier Sequoia S.A., Lausanne, 1977, pp. 132-133.

*Primary Examiner*—Roy V. King
*Attorney, Agent, or Firm*—Fred A. Keire; George B. Snyder; William J. Spatz

[57] ABSTRACT

A method for depositing continuous cohesive, non-granular tightly adhering deposits on a substrat by using a rotating fibrous transfer means; deposit starting material is a small particle materials such as diamond powder; or powders of complex materials such as superconducting materials such as of the Y—B—C—O type; discrete deposits may be made and thereafter built-up on the substrate.

6 Claims, 10 Drawing Sheets

FIG. 5
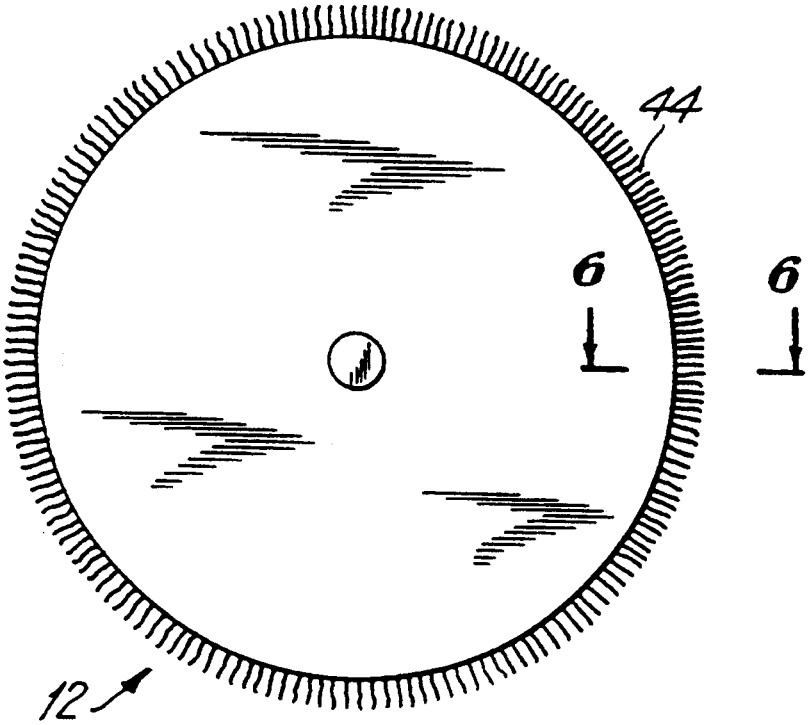
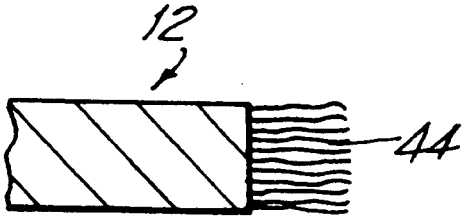
FIG. 6
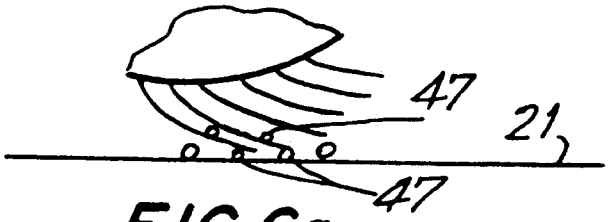
FIG. 6a 44
11a
12
49
47
48
50
51
21
52
23
50
50a
44
12

"COATING PROCESS FOR DEPOSITING EXTREMELY HARD FILMS ON SUBSTRATES"

This invention relates to the art of depositing very hard substances as coherent, non-microporous and tightly adhering structures on a variety of substrates; more particularly this invention relates to the art of depositing a starting material in a fine particle form as a coherent, densely packed, nonmicroporous and tightly adhering structure of improved structural properties on a substrate which is substantially entirely physically unaffected by the deposition process but on which substrate surface the interior deposit surface replicates the substrate surface, yet presents a smooth tightly packed exterior surface of excellent coherence and outstanding properties such as smoothness, etc. Still more particularly, this invention relatives to the deposition of improved diamond, cubic boron nitride and like extremely hard films on surfaces such as glass, iron alloys such as from cast iron to mild steel to highly alloyed steels such as tool steels of the H.I.P. type (hot isostatically pressed) and other tool materials such as nitrides, carbides, carbide alloys or mixtures and the like. The inventive process allows production of a single composition deposit, physically mixed deposits, deposits of various chemical composition, deposits of layered composition including deposits resulting a chemical interaction of the deposit with codeposited compositors, and interaction deposits with a substrate surface including such interaction in presence of gas environment surrounding an enclosure in which such deposition takes place. Removal of the substrate such as by dissolution, i.e., etching allows the obtention of self-supporting deposits of properties not obtainable or readily obtainable in such materials, e.g., hexagonal close packed diamond crystallites in deposit made from diamond powder on an etchable, i.e., removable substrate, e.g., glass.

An improved apparatus for achieving the above deposits forms part of the invention herein. These and other materials, their production as deposits, the means used to accomplish such production and the conditions therefor will be explained in further detail herein sufficient to enable an ordinarily skilled practitioner to practice the various aspects of the present invention.

BACKGROUND FOR THE INVENTION

In my previous U.S. Pat. No. 4,741,918, granted May 3, 1988, I discussed a method for coating a substrate by rotationally dragging substantially dry discrete particles of the coating material across the surface of a substrate with a sufficient rate of energy input to cause these particles to adhere. In my South African Letters Patent No. 85/0580, I also disclose in a companions method the making a Teflon (Reg. TM of DuPont Co. for its poly tetra fluro ethylene polymer) coatings on a sensitive substrate. The present invention is a further development and improvement of the teachings found in the above patents and constitutes a further advance in the art of making improved deposits from dry discrete particles.

In addition, U.S. Pat. No. 5,140,783 illustrates a demarcation line. This patent illustrates the employment of felt pieces with abrasives imbedded therein as a means for achieving extremely finely polished surfaces of outstanding smoothness despite the irregular surface geometry and its complexity of the material being polished.

The last patent also points out the demarcation of an abrasive particle action confined in a substantially resilient yet firm oscillating environment and the transfer of a substantially hard particle, as a deposit on a substrate shown by my U.S. Pat. No. 4,741,918. The demarcation between a "soft" fibrous transfer means and an unacceptable hard fibers and hard materials such as felt will be pointed out further. In my previous patent such demarcation was not known to me and was not drawn and forms a further basis for the present discovery.

The prior art found in the above U.S. Patents forms part of the background and constitutes the knowledge over which this invention is a further advance as will be explained in further and specific detail herein.

BRIEF DESCRIPTION OF THE INVENTION

In accordance with the teachings in my previous patent but as a distinct improvement thereover, the present invention comprises the following improvements over my previous invention.

Whereas in the previous invention the powders were sought to be deposited from the surface of a resilient material, it has turned out that a finer demarcation must be made between "soft" surfaces and fibrous surfaces. According to the present invention, the small particles of the material are deposited on a substrate from a fibrous environment in which these particles are held by a combination of mechanical-electrostatic forces where the fibers touch very little if any of a work piece surface. Thus, while in the previous patent there was no appreciation of the disadvantage that buffing wheels versus soft fibers offer, it has now been found that fibers of a length from about ¼ to 1", have been found especially advantageous for the improved deposition. The length of fiber is dependent on the size i.e., diameter of the transfer means. The above length is typical for a fibrous transfer means from about 8 to 12 inches in diameter. Smaller diameter transfer means may be run at higher R.P.M. and is proportional to the radius. Hence, the rotational speed is proportional to the radius. The control of deposition, the controllable variation in properties and the like are vastly improved over my previous patent by the mere adoption of properly constructed fibrous transfer means heretofore unrecognized for the significance thereof.

In combination therewith, it has now been found that deposit properties are affected by the precise construction of the rotational fibrous means, the environment surrounding it, and the elimination of a liquid spray with which I previously transferred the particle and particulate material to the rotating particle transfer means, etc.

Moreover, it has now been found that greater rotational velocities are used for achieving a significantly better deposit and better deposit control. For example, it has now been found that initial deposition regime which was employed by me was insufficient and that rotational velocity needed is vastly different from desired subsequent build up rotational regime for the same deposit. Such unexpected contribution has not been disclosed in my previous patent.

Likewise, properties achievable with prograde movement of substrate vis-a-vis the fibrous rotational means of predetermined rotational regimes are significantly different from the retrograde movement for comparable pre-determined rotational regimes and introduce opportunities for layered deposit construction on a substrate heretofore not achievable and not taught by my previous deposition technique. Further, in distinction from my previous patent, I have found that particle and particulate introduction and control thereof, the amount of particles introduced, the shape of particles, the avoidance of vortex turbulence generated by the fibrous particle transfer means occasioned by the increased velocities, etc., have required employment of means heretofore not recognized or appreciated for the necessity thereof.

For example, careful construction and employment of doctoring means with the rotational particle delivery means affords control with far greater precision for the particle introduction to the fibrous rotational means and hence the deposits that are realized. Likewise, precise position control of the rotational means vis-a-vis the work piece and the noncommitment amount of particles in the contact position establishes more efficient deposition regimes, pressure controls and thus the ultimate deposit characteristics such that the life of the fibrous transfer means is vastly improved, and the deposit may be obtained of tailor-made properties heretofore not recognized in the art for single composition deposits, mixed composition deposits, or in the chemical co-reaction generated deposits. Consequently, the present invention allows deposition of a vast array of hard-to-deposit materials in various combinations on a substrate surface without having substantially any effect on the physical nature of the substrate.

The present invention thus provides an alternate method to the previous deposition techniques which severely affected the surface characteristics of the substrate by physical alteration of same, e.g., scratching and filling of marred surfaces, by using melt technology, by chemical change of the substrate surface, etc., e.g., such as shown in U.S. Pat. Nos. 4,358,506, 4,396,677, 4,374,903, 4,376,806 and 4,426,423, by electroplating, by ion-implantation, by chemical vapor deposition (CVD) or like means mentioned in the art or in my previously issued U.S. Patent.

DETAILED DESCRIPTION OF THE INVENTION THE FIGURES AND EMBODIMENTS THEREOF

With reference to the drawings herein and the embodiments of the invention shown in the drawings and wherein:

FIG. 5 illustrates a top view of a finished fibrous transfer means for the deposition of particles;

Figures 7, 7A:
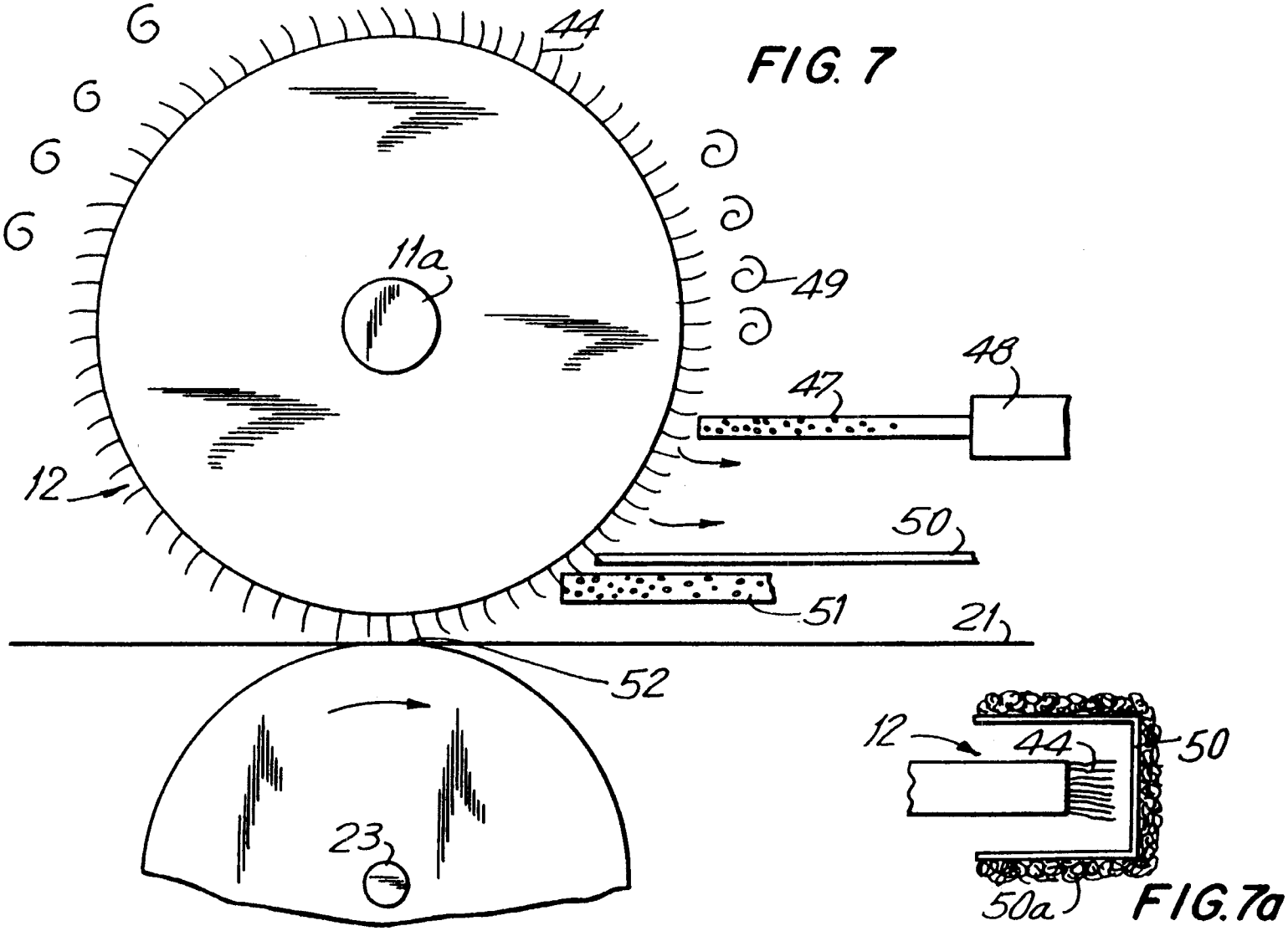
Figure 8:
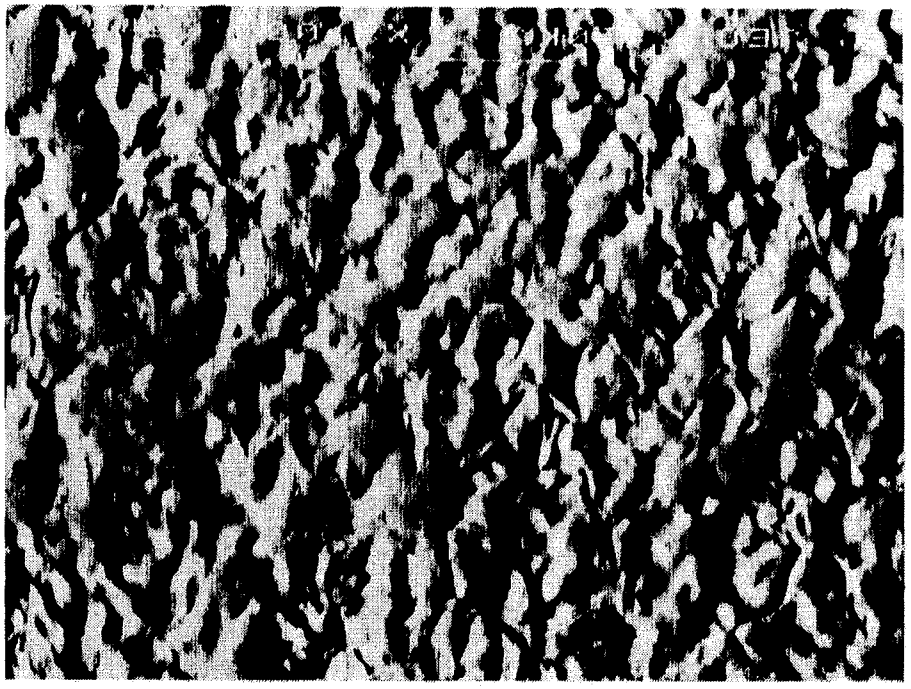
Figure 9:
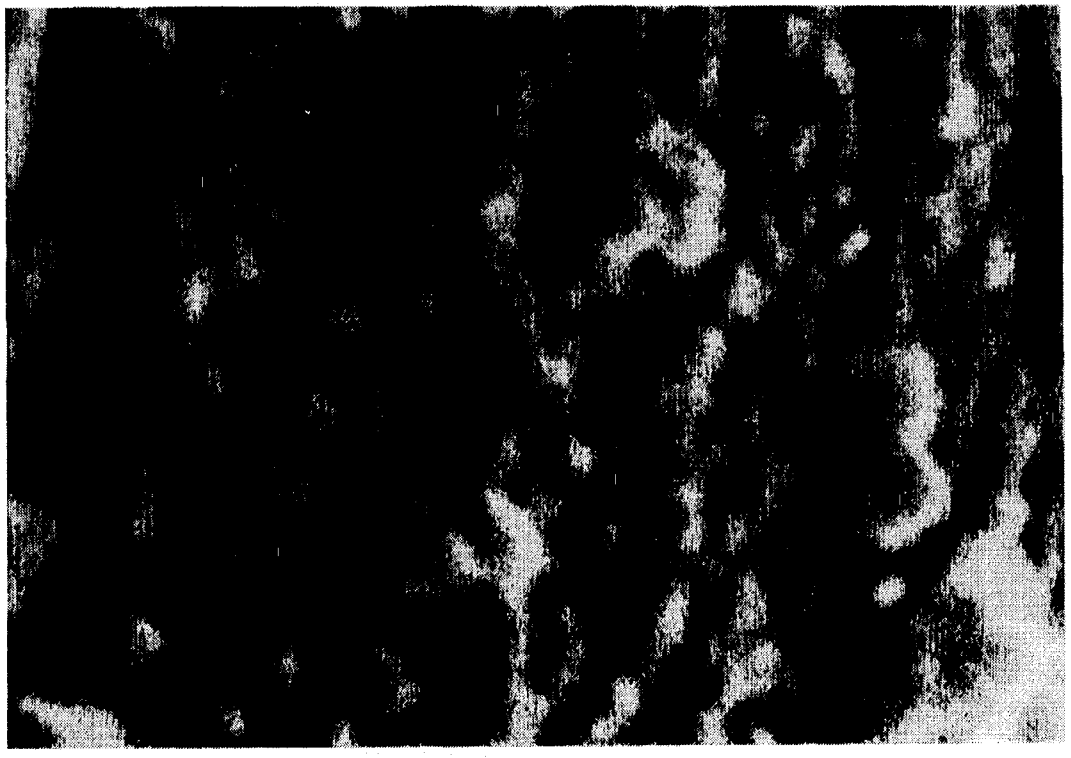
Figure 10:
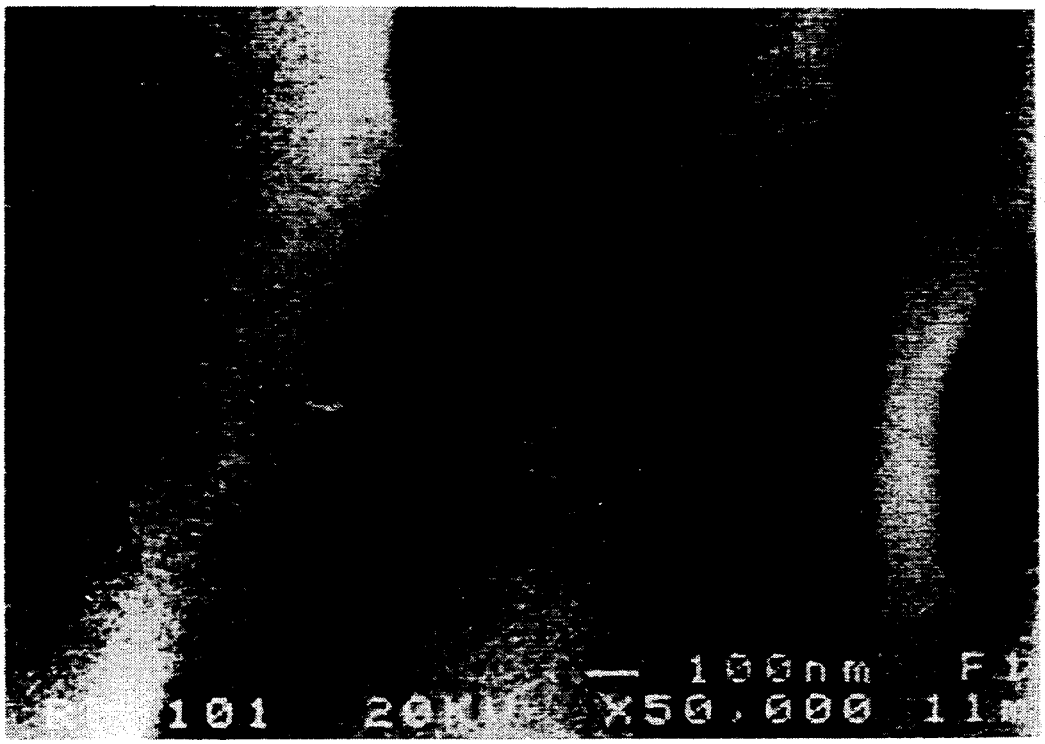
Figure 11:
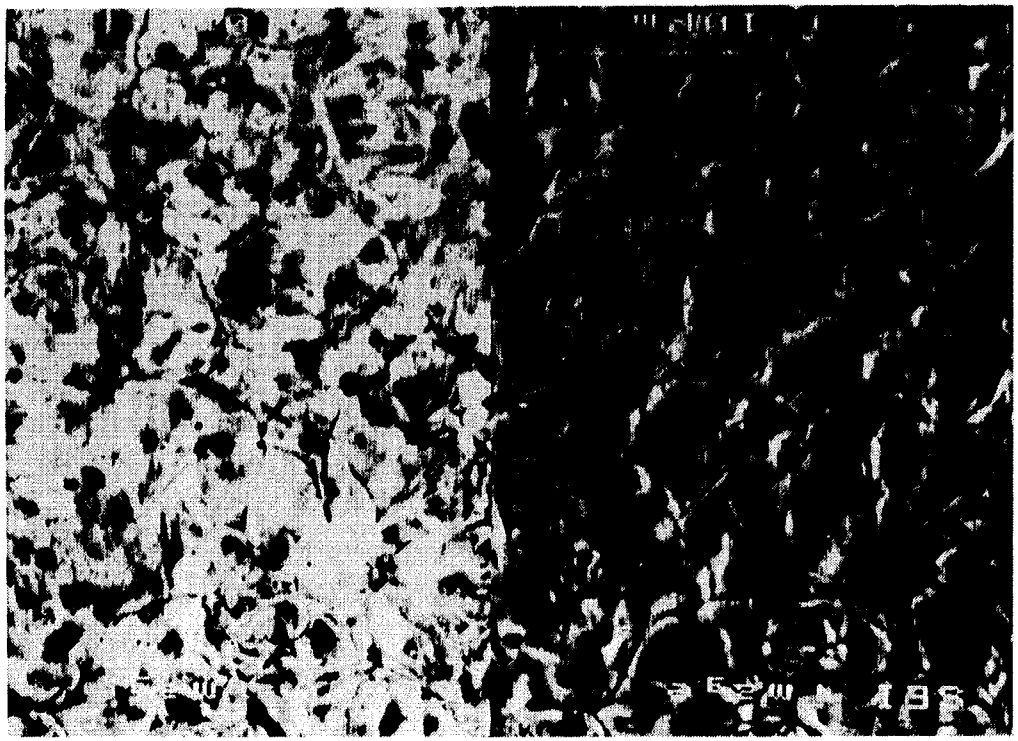
Figure 12:
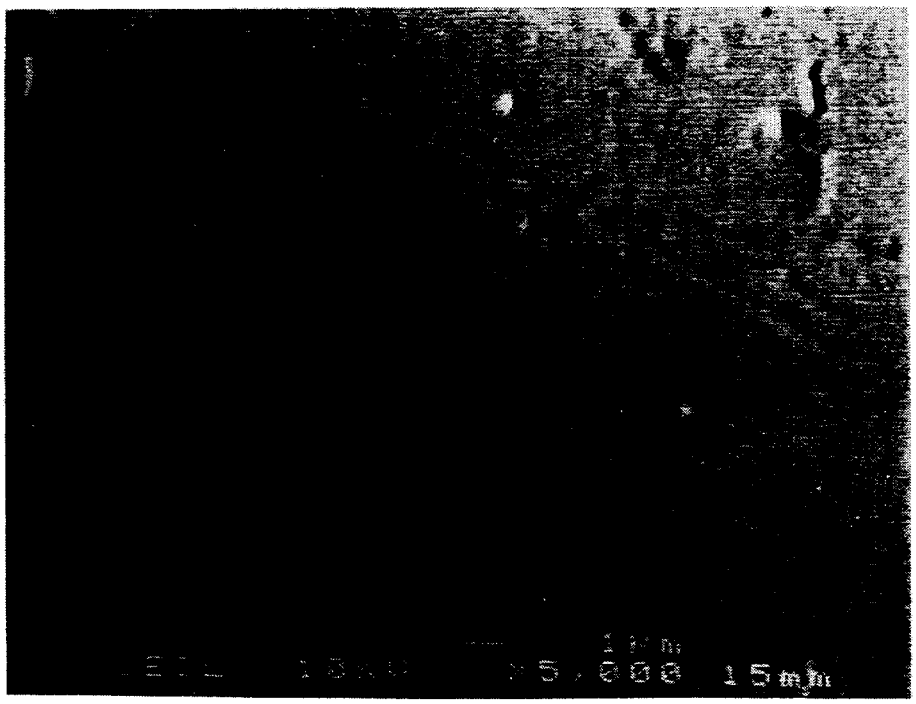

FIGS. 6 and 6*a* illustrate a cross-sectional detail of the fibrous transfer means shown in FIG. 5 along lines 6—6 thereof;

FIGS. 7 and 7*a* illustrates a means for introducing the particles, i.e., powder and the like in an efficient manner onto the transfer means;

FIG. 8 illustrates a photomicrograph of a magnification of 2,000 of a surface of a razor blade;

FIG. 9 illustrates a photomicrograph of the interior surface of a diamond deposit on a razor blade surface of FIG. 8, but of a scanning electron microscope magnification of 50,000 times after removal of the steel from the self supporting diamond film deposit thus illustrating the replication of the blade surface of FIG. 8;

FIG. 10 illustrates a photomicrograph of the top surface of the diamond deposit of FIG. 9 at a scanning electron microscope magnification of 50,000;

FIG. 11 illustrates a photomicrograph of a strip of a stainless steel blade blank at 2000× magnification; and FIG. 12 illustrates a diamond deposit on the blade of FIG. 11 at 5000× magnification by a scanning electron microscope at 10 KV scan level.

Figure 1:
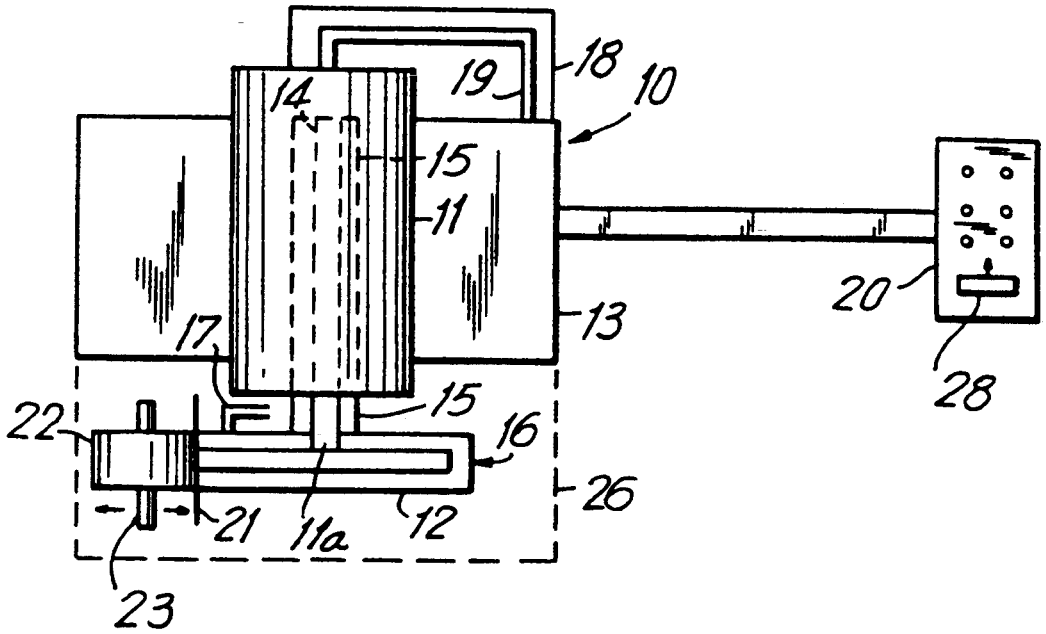
FIG. 1 illustrates a front view of an apparatus including the fibrous transfer means used for particle deposition with an enclosure means for confirming the particles (shown in dashed lines for the same)

Turning now to FIG. 1, it shows the deposition apparatus 10. It consists of a motor 11, which typically is rotated on air bearings to allow the high rotational velocities of up to 25,000 rpm. The employed velocities are governed by the fibrous transfer means identified as 12 in FIG. 1 and elsewhere. The motor 11 is available such as from West Wind Air Bearing Ltd., Poole, Dorset, England, a division of Federal Mogul.

Typically, a motor 11 is of up to 25 horsepower to impart the necessary velocity and drag to the fine particles. The additional velocity needed is as an improvement over the disclosure in my previous U.S. Pat. No. 4,741,918, and is also caused by the necessity occasioned by the employment of the fibrous transfer means 12 employed to transfer with sufficient causative force to form the herein described improved deposits. Frame 13 on which motor 11 is mounted may be provided with means such as a rail 14 for lowering and raising the motor 11 on frame 13, by means of a rail car 15 mounted on top of rail 14.

A fibrous transfer means enclosure 16, is provided to capture any unused particles and recycle these such as by removing these particles through conduit 17. The fibrous transfer means enclosure 16 is mounted on the rail car 15. Electrical conduit 18 is connected to control panel 20. A pneumatic line 19 is connected to a compressed air source (not shown) which provides air at about 8 to 15 psi (gauge) to the motor 11 bearings. A work piece 21 is urged against the fibrous transfer means 12 under appropriately carefully controlled pressure by back-up means 22 in the form of a roller or a slide plate, or like means. Such arrangement is needed to select the desired pressure by the fibrous transfer means 12 against the work piece 21. The adjustment of the pressure has been schematically illustrated by the arrow movement on back-up means spindle 23. Such adjustment should be made in fine increments and vernier devices (not shown) may be employed for that purpose. The actual operation and adjustments will be discussed further in connection with the deposition of the selected material on the work piece 21.

A take-up means 24 in the form of a roller or a complementary roller 25 form a nip therebetween (not shown in FIG. 1, shown in FIG. 2) and allows the withdrawal of the work piece 21 from the apparatus enclosure 26 (or within the apparatus enclosure if it is so desired); i.e., extension of apparatus enclosure 26 may wholly confine the work piece within apparatus enclosure 26. A feed roller 27 (not shown in FIG. 1, shown in FIG. 2) for work piece 21 may be provided likewise outside or inside the apparatus enclosure 26. As it will be described further herein, the work piece 21 may be in form of a rigid shape, may be a small, jig supported device (a jig for holding has not been shown), or a work piece 21 may be mounted in a carrying strip and advanced in a step-and-index fashion such that not only individual pieces may be coated but these may also be coated continuously. The variations for feeding a work piece 21 are well known in the art such as employed for step-and-index strips which carry electrical connectors, when plating individual pieces, or individual sections on these connectors and like devices used in high rate production lines. These devices need not be described in greater detail because these approaches are well known. Nevertheless, small buttons or sections of material sought to be made these are made on raised sections of such strips as it is known in the art. However, each individual work piece 21 is urged appropriately against the fibrous means 12 such as to effect a transfer of the desired particle type as a solid deposit. A carrier belt (not shown) may be considered the work piece 21 and then after appropriate deposition the work piece 21 may be removed such as by dissolution or etching. Such free standing deposits may be made of compositions to achieve the sought deposition type and characteristics of the deposit.

An R.P.M. indicator 28 and various R.P.M. adjustment devices (not shown) may be provided on the control panel to control the rate of rotation of the fibrous transfer means 12. As shown in FIG. 1, the fibrous transfer means 12 is mounted on motor spindle 11*a*.

Figure 3:
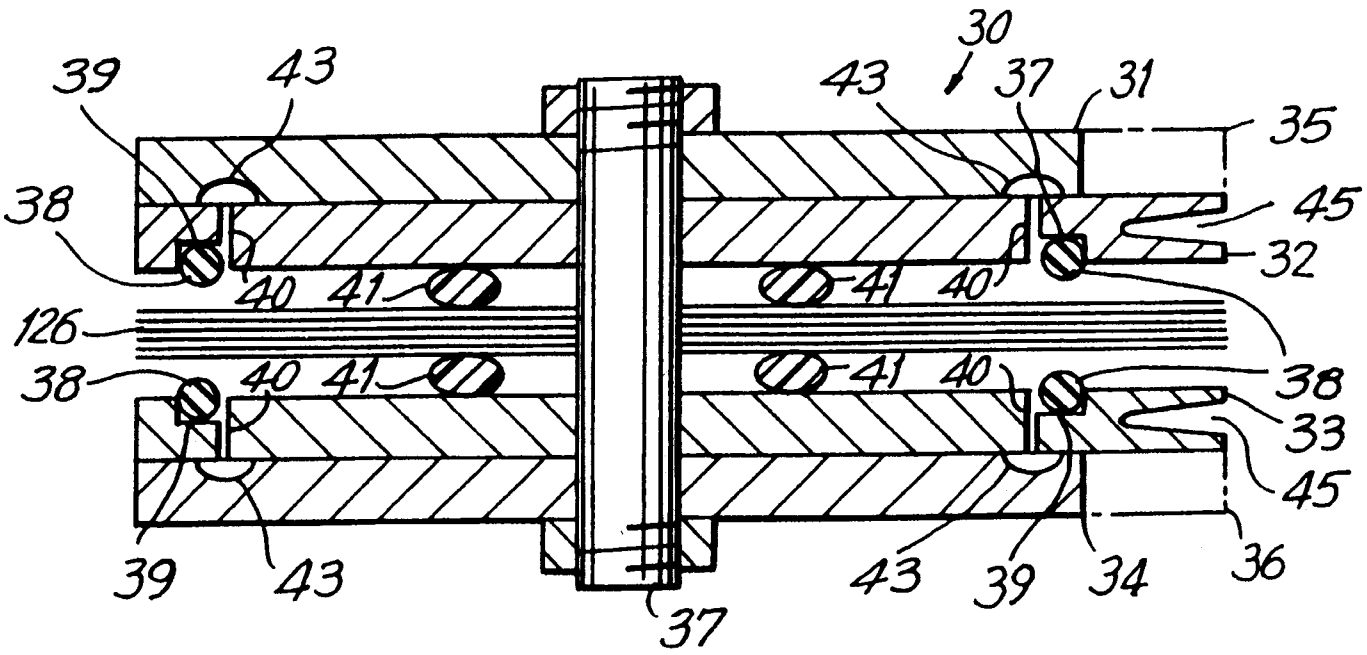
FIG. 3 illustrates a cross sectional side view of a device for constructing the fibrous transfer means for the particles.

Turning now to FIG. 3, it illustrates a device for preparing the fibrous transfer means 12, described in conjunction with FIG. 1 and further illustrates significance of the precise means used to control the desired formation of deposits of predetermined characteristics. In FIG. 3 a device 30 for constructing the fibrous transfer means 12 has been shown. Device 30 consists of four plates each identified with its identifying number, i.e., upper outside plate 31, upper face plate 32, lower face plate 33, and lower outside plate 34, respectively. A variation in the four plates has been illustrated on the right hand side of all plates and for the upper and lower outside plates identified with items 35 and 36.

A central post 37 is provided which corresponds in size to the motor spindle 11*a*. The precursor 12*a* of the fibrous transfer means 12 has been shown in FIG. 3 and consists of multiple layers of woven material plies 12*b*. Typically from about 8 to about 25, desirably 10 to 16 plies 12*b* are used. Each ply 12*b* is rotated vis-a-vis its predecessor ply by an appropriate angle not to exceed 90° but typically 45°. Thus each ply of the woven material is displaced appropriately so as to present, on the outside, the fibers which have been teased from each ply 12*b* in a circumferential region identified by the compression rings 38 found in the corresponding upper and lower face plates 32 and 33, respectively. Each compression ring 38 sits in a groove 39 in the upper and lower face plates 32 and 33 and these grooves 39 in turn communicate with the upper and lower outside plates 31 and 34 via a plurality of channels 40 positioned at about the periphery of the fibrous transfer means 12 where a solid center section of the fibrous transfer means 12 is formed by the spreading of a suitable, measured amount of a reactive high strength resin identified by two resin beads 41 found in FIG. 3 between the upper and lower face plates 32 and 34 and circumferentially around the central post 37.

A typical high strength reactive resin shown by resin beads 41 is such as cyanomethacrylates of various types (also known as "Crazy glue"). These resins are preferred because of their desirable, very slight creep properties. Creep has been experienced at high R.P.M. velocities with other less acceptable, but still useable, resins such as epoxy resins.

Figure 4:
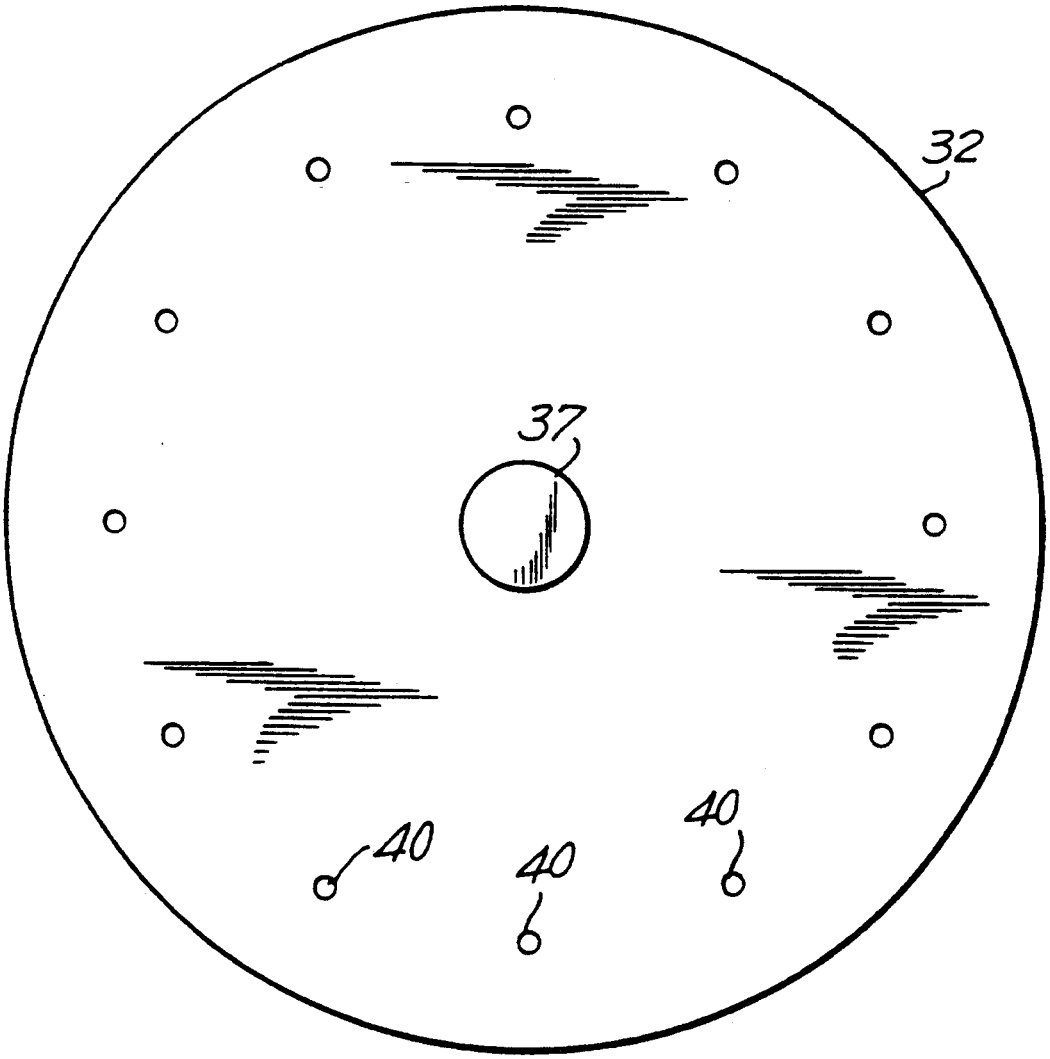
FIG. 4 illustrates a top view of the device for constructing the fibrous transfer means shown in FIG. 3 including the details for providing a hard central core of infused material to impart rigidity to the fibrous transfer means.

Upon tightening of the four plates 31, 32, 33, and 34, by compression such as by pneumatic means, or by tightening the nuts 42 on central post 37, the resin in beads 41 is infused into and throughout the individual plies 12*b*. However, compression rings 38 prevent the migration of the resin past or beyond the circumferential extent of the plies 12*b* and thus leave an outer peripheral edge of the fibrous transfer means unresinated and unreacted, i.e., beyond compression rings 38. Any excess resin is channelled through channels 40, also shown in FIG. 4, and gathers in the circumferential excess resin groove 43 found in each of the upper and lower outside plates 31 and 34, respectively.

After a suitable infusion time of resin beads 41, the device 30 is disassembled, i.e., before the resin is excessively set and the resin in the fibrous transfer means 12 allowed to cure for a prescribed time for the resin.

Thereafter device 30 is soaked in an appropriate solvent to remove excess resin and cleaned so as to be ready for an assembly of the next fibrous transfer means 12. Appropriate release compounds, well known in the art, may be used to coat all surfaces of the device 30 exposed to the resin. The approximate length of the unresinated fibers 44 shown in FIG. 5 fibers is defined by the distance between compression rings 38 and the edge of the plates 31, 32, 33 and 34. The unresinated fibers 44 may vary from about $\frac{1}{4}$ inch to about one inch, but the desired length for each particular particle material is established by trial and error within a $\frac{3}{4}$ inch range. Typically this length will range from about $\frac{1}{4}$ to about $\frac{3}{4}$ inches but a good starting point is a fiber length of $\frac{5}{8}$ inch.

In order to allow the fibers to splay out during compression for the longer fibers, the plate gaps 45 may be provided in the upper and lower face plates 32 and 33, respectively. These gaps 45 have been shown for the right hand side of device 30, but are equally intended for the left hand side. In any event, both embodiments are disclosed so as to provide for an illustration how the fiber 44 length may be provided.

With reference to FIG. 5, it illustrates the completed fibrous transfer means 12. As a suitable material for plies 12*b* are finely woven fabrics of silk, wool, cotton, linen, hair and other synthetic fibers that will not melt (but will char). Prominent among these are all finely woven Kevlar fabrics of fine denier weight in the yarns, i.e., of a denier weight equivalent to 400 denier (International) but preferably 200 denier international and less fine cotton goods of counts ranging from 35's to 80's even up to 120's; fine wool of combings and spins of 64's to 74's and like materials of the above measures, of course, it is possible to use a less fine material but stiffness of fibers affects the deposit quality.

The finer fabrics are preferred because the fine fibers 44 are more effective and desirable. Among the fabrics which are the foremost candidate fabrics are such as silk, Kevlar and cotton. Fine hair such as animal hair are suitable except for their cost. Fabrics made of abrasive materials such as carbon fibers are considered inferior and should not be employed. In fact carbon fiber if used acts as a cutting tool.

Likewise fabrics made of low melting temperature polymers are inferior and do not lend themselves to the construction of device 12. Instead of a plies 12*b* being made of entirely of the same material, e.g., silk or soft animal hair such as mohair, rabbit fur and the like, a woven ring (not shown) may be used and these fabric rings (or some individual complete plies) interdigitated with layers of woven or nonwoven high tensile strength material, e.g., low creep materials such as carbon fiber and then the whole assembly infused with resin and made as previously described. In such event the fibers 44 are teased and combed subsequently to the formation although such teasing, if carefully done, may be done beforehand.

It is emphasized that the particles 47 are typically held in the fibrous transfer means 12 in part by electrostatic force, and in part by mechanical force because of the nature of fibers, e.g., the physical configuration of the wool fibers or animal hair fibers, cotton, i.e., cellulose, e.g., cotton or linen, etc. In fact, in dark when depositing a material, tiny sparks are seen between a work piece 21 and the fibrous transfer means 12. Other fibers hold the properly dispersed particles higher electrostatic force, e.g., Kevlar. As mentioned before extremely fine fibers are now being drawn because of the ability to make extra fine spinnerette holes in extrusion dies by means of laser beams, etc. For this reason Kevlar (registered trademark of DuPont) or any other polyamide polymers such as Tawron (registered trademark of AKZO Corp.) are desirable.

After completion of the fibrous transfer means 12, the fibers 44 are trimmed to as uniform a length as possible. First a gross trim is achieved by running fibers 44 against a fine sand paper and the like and thereafter against a razor blade or like trimming device at or very near the operating rotational rate or velocity for the particular fibrous transfer means 12. Typically such running is necessary because of the inherent stretching of the fibers 44.

It has been found that the best deposit characteristics and results have been achieved when the fibers 44 protrude peripherally to the same length as all other fibers. FIG. 6 is intended to illustrate that principle for a fully formed fibrous transfer means "run-in" at an excellent rotationed velocity. Fibrous transfer means are contemplated of a diameter from the smallest operable in confined tubular space as low as 1" and even lower to up to 12" in diameter.

In FIG. 6*a*, the individual particles are shown schematically as enmeshed in the fine unresinated fibers 44. It is to be understood that not only individual particles are intended but also individual particles formed into particulates i.e., particles agglomerated into a fine clump, i.e., particulates, which consist of a plurality of particles. Such coalescing might be the result of electrostatic forces as well as other conditions which cause the particles to agglomerate. However, these particles should not be too coarse. At high velocities the coarse particles are expelled from the fibrous transfer means 12.

Although the precise mechanism by which the process works is not known, a few speculations might be in order. It is presently surmised that the particles 47 become entrapped and in part held electrostatically in the fibers 44 and are then dragged along the surface of a work piece 21.

Because of the very high velocity, i.e., rotational velocity, each particle 47 loses a part of its energy including electrostatic energy to the asperities and fissures of the work piece 21 and thus fills by an unknown mechanism the fissures and valleys in the work piece 21. This mechanism is surmised from the photomicrograph of FIGS. 8, 9 and 10, but especially FIG. 9 which shows the underside of the self-supporting diamond deposit left as a structure after the underside has been taken away such as by etching. Interestingly, such replication is also found on a relatively smooth surface such as glass and on relatively soft materials, e.g., polycarbonate resins. On an amorphous surface such as glass, diamond apparently has been deposited as a crystallite, i.e., in a crystalline structure. Such phenomenon by itself is unusual as it has been heretofore believed that crystalline structures could not be made on an amorphous base material.

The particles 47 which are used are generally extremely fine for hard materials, but may be more coarse for lighter materials and are in the range from colloidal type particles up to 1 micron to 10 microns in diameter. Typically diamond dust is of size that is classified as from 0 to $\frac{3}{4}$ micron (also called "sub-micron" particles) and such dust is useful in the production of the diamond film in accordance with the present invention. The particles 47 also seem to be retained in the fibrous transfer means 12 and are not expelled from the rapidly rotating fibrous transfer means 12. However, the coarser particles are often expelled, these may be separated from other desirable size particles such as in a cyclone(s).

It has been found by experience that the particles 47 should have sufficient angularity as measured by an angle of repose for a pile of such particles. If the angle of repose as measured by an appropriate standard, e.g., ASTM, DIN, etc., is more than 35°, but desirably about 45° and above, sufficient films may be obtained without excessive residence time of the work piece. Excessive residence time is measured as that time which causes the work piece 21 to develop a surface temperature which affects the surface for the work piece 21 or affects the integrity of the fibrous transfer means 12. Consequently substantially spherical particles act as roller bearings and are not acceptable. It is well known how to obtain particles of sufficient angularity e.g. by shattering round or larger particles on impact when ejected in a stream of liquid nitrogen against a stationary target. Hence, particles 47 as are desired may be readily obtained.

Another self-correcting feature of particle size has been found by a novel introduction of the particles as shown by the apparatus of FIG. 7 which illustrates in a partial top view the fibrous transfer means 12 and the motor spindle 11*a*. Particle injector 48, is very inefficient because the air turbulence 49 (illustrated only schematically) created by the rapidly rotating fibrous transfer means 12 is sufficient to disrupt the introduction of the efficient introduction of the particles 47. In distinction from my previous patent, I have found that it is necessary to have a doctor blade 50 to remove air turbulence 49.

The doctor blade 50 deflects ever so slightly the fibers 44, but in its wake creates a slight suction effect such that when a particle 47 introduction conduit 51 is appropriately positioned, in very close proximity to the doctor blade 50, the particles 47 get sucked into the fibrous transfer means 12 to be then delivered to the work piece 21. A suitable angle for doctor blade 50 and particle introduction conduit 51 and their position are a function of the particle composition and rotational velocity of the fibrous transfer means 12 and is also used as a means to control the amount of particles in the work zone nip 52.

Instead of a doctor blade 50, a steel wool baffle may be used to cancel the various frequencies of the turbulence and cause the particles to be introduced more uniformly on the surface of fibrous transfer means 12.

Insufficient particle 47 introduction is characterized by the transfer of the fibrous material from fibers 44 themselves onto the work piece 21 and defines the lower unwanted limit for particle introduction.

The upper limit is found by excessive "flooding" of work zone nip 52 displayed by the particles acting as a lubricant, i.e, the lubrication is by the pulverulent particles. The high rotational velocities also tend to expel any coarse particles from the fibrous transfer means 12 which then may be separated such as in a cyclone(s) (not shown).

It has been further found that the deposit control and the quality of it for any given particle type is well controlled by a combination of at least four elements:

1. rotational velocity of fibrous transfer means
2. the nature of the fibers 44;
3. the amount of introduced powder; and
4. the variation in pressure of the work piece 21 against the fibrous transfer means 12.

Initial deposit formation is best carried out with as little as possible pressure exerted by the back-up means 22 on the work piece 21. Fibers 44 should slightly touch, if at all, the work piece 21. Under such conditions a deposit on the work piece shows little surface striations and surface, i.e., substrate surface damage. If undue or excessive pressure is used, coupled with slow rotational velocity surface striations become so predominant that in essence fibrillation occurs, i.e., fibrous strings are deposited on the work piece 21. Moreover, retro- grade movement of the work piece 21 (against the rotational direction of the fibrous transfer means) produces dense, closely packed structures (such as hexagonal close packed crystallites of diamond) in the deposit whereas pro-grade movement produces porous (microscopic) deposits of considerably less density. Hence, the preferred embodiment of the invention contemplates the retro-grade movement of work piece 21.

In distinction from my previous work where only a single deposit film was sought and achieved, and a hard buffing wheel (which tended to develop on the wheel hard spots and cause uneven deposits) it has been further found that a number of rather unexpected discoveries occurred. These allow the production of layered deposits if a physical mixture of particles of different compositions are mixed. It appears that each different compound or element has a "deposition activity coefficient" for given rotational velocity. These physical mixtures will deposit on the work piece 21 in a layered configuration one versus the other. For example, a single powder which was believed to be ferric oxide was in fact a mixture of $Fe_2O_3$, Cu and carbon powder and surprisingly deposited in a sequence of $Fe_2O_3$ first and Cu second and carbon third.

Further exploration has yielded various layered composition, but each mixture must be established for its layering propensity by experience and with reference to the substrate surface properties thereof.

Surprisingly, however, inorganic compositions and organic compositions of the most complex nature such as powder the superconducting compound of type YBCO, e.g., Yttrium, Barium, Copper Oxides, namely $YBa_2Cu_3O_{7-x}$ (delta) wherein in $O_{7-x}$, x is about 0.06 (other O values are 6 and 8 and fractions of these integers), will deposit almost substantially entirely integrally non-layered in their proper compositional ratios as found in the precursor compositions in the herein method. Except for slight $O_2$ deficiency which may be added such as by oxygen annealing the compounds are identically deposited on the substrate. Similarly, other superconductor materials are likewise suitable for deposition.

Such films have been heretofore impossible to obtain of proper physical properties and proper adhesion to substrate. Another aspect of the present invention is the unexpected phenomenon that some reactive gaseous atmospheres will intermix with the deposit sought to be made. Thus, nitrogen may be introduced from low temperature decomposable ammonia compounds such as very slight amounts of ammonia crystals, e.g., ammonium nitrate. Such chemical reactions in the work zone nip 52 are only one of the unexpected discoveries which are especially surprising. The opportunities such reactions present are highly unexpected. For example it is postulated that significant, e.g., p- and N- junction production may be possible in a diamond film with these reactants which then may function as solid state device.

Another aspect of the present invention not known to me previously is that there is considerable energy expended for the initial deposit formation on a surface. Continuing such deposition using the same pressure and same rotational velocity for the fibrous transfer means 12 will not add material; continuous deposition or retarding of work piece 21 movement will not increase the deposit thickness.

However, if the work piece 21 is again run thought the same (or different) work zone nip 52 at lower rotational velocity (i.e., lower pressure or different rotational velocity) in a retro-grade fashion deposit thickness may be built up substantially, e.g., using an initial rotational velocity of 15,000 r.p.m. for a 12 inch fibrous transfer means 12 resulted in a diamond film of approximately about 200–300 mean average Angstrom unit thick deposits. Running the work piece through the work piece nip 52 the second time under rotational conditions of, e.g., 6000 rpm, at same pressure setting as previously or an increased pressure setting, a 50 microns thick deposit is found on a work piece 21. If higher pressures are used striatiens are formed in the deposit. If still higher pressures are applied against the fibrous transfer means 12 an abraded work piece 21 results. Such combinations in rotational rates and pressures are established for each composition of particles and for each work piece by the prescription for these as outlined above. This practice would be required by me or anyone so inclined to practice the herein disclosed method but cannot be considered undue experimentation as that term is considered by those of ordinary skill in the art.

As another aspect of the invention, the particles 47 may also be introduced in a manner such that the doctor blade 50 baffles the turbulence by a U-shaped device or may have a U-shaped or horseshoe shaped steel wool collar 50*a* as illustrated in FIG. 7*a* of suitable size and density. A steel wool device 50*a* also cancels out noise by mixing up the encountered noise frequencies generated by turbulence. The doctor blade 50 design of FIG. 7 or 7*a*, takes advantage of effects such as Coanda effect for channelling the turbulence effects and may result in the proper focusing of the particles 47 as these are properly introduced onto the proper location on the peripheral surface of fibrous transfer means 12.

Ultimately the end result of any powder introduction and the resulting deposit is tested for the deposit itself. For example, for a diamond film by the dielectric properties of these films for their integrity at conditions which establish the deposit, i.e., the film integrity, porosity, fissures and the like. That diamond is an excellent insulator (unless it is doped to become a solid state device) and any deficiency in the deposit shows up at increasingly higher frequencies. By such procedures the microscopic imperfections in the deposit will tend to be established by performance criteria thus showing the breakdown of the deposit integrity.

It has also been found that the work zone nip 52 may also be cooled with introduction of inert gases at low temperatures, e.g., argon gas or nitrogen gas as it appears necessary.

The diamond particles or particulates useful in the practice may be synthetic, e.g., available such as from DuPont of Wilmington, Del., U.S.A. produced by shock explosion procedures and the like.

It is to be understood that each particular particle composition appears to have its own deposition energy, i.e., rotational energy. Such energy input it appears, all conditions being equal is highest for harder particles of same size (assuming same angularity), e.g., diamond, cubic boron nitride, titanium nitride, carbides obtained from typical carbide nitride, formers disclosed in the above U.S. Patents, etc. Difficulty in deposition decreases with decrease in the hardness. However, while there is not an absolute predictability as indicated by a scatter of data experienced with different compositions, there is sufficient correlation to make an appropriate decision based on hardness and particle size. Larger particle sizes require more energy.

Figure 2:
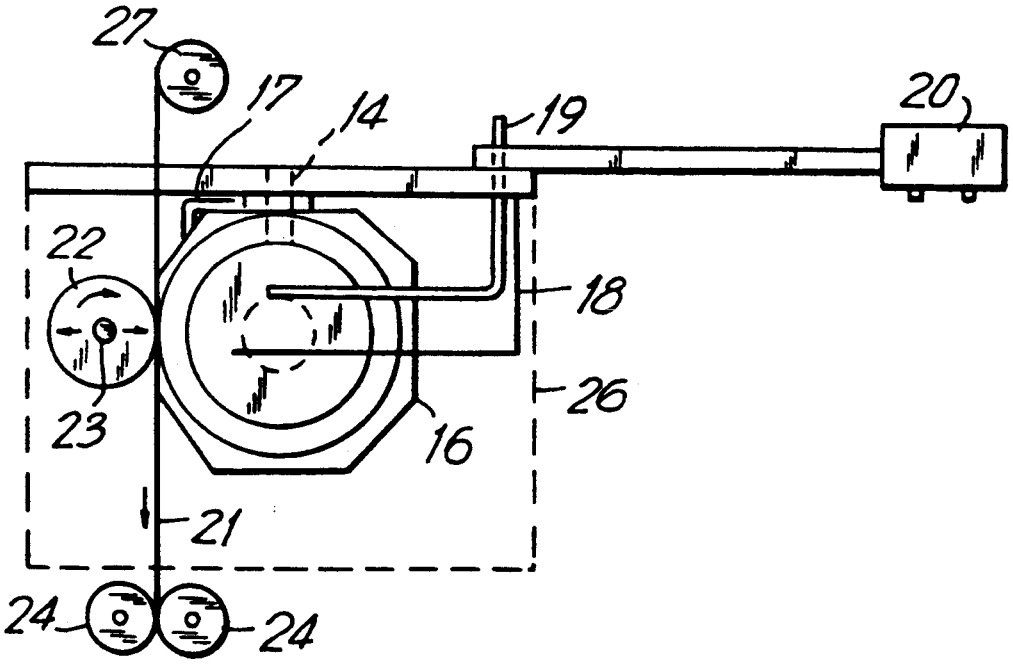
FIG. 2 illustrates a top view of the apparatus shown in FIG. 1 with the enclosure means therefor as shown in dashed lines.

Turning now to FIGS. 8, 9, 10, 11 and 12 these illustrate the invention as it has been achieved by the apparatus 10 of FIGS. 1 and 2. These figures show that a surface of an uncoated razor blade in FIG. 8 and 11 of stainless steel typically employed in razor blades is a very uneven surface at a magnification of 2,000. When the uncoated blade is subject to a deposition of 0–$\frac{3}{4}$ micron size diamond particles (graded size) at 15,000 r.p.m. by an 8 inch diameter fibrous transfer wheel, the surface of the deposit appears rather smooth at a magnification of 50,000 times. Although there are dimples in the face of the deposit and apparent striations, the quality of the deposit may be improved still more by running the fibrous transfer means 12 at above 15,000 R.P.M. at same pressure setting or at a slightly lighter pressure. Moreover, the further finishing results in filling up the dimples and smoothing of the surface.

One of the surprising manifestations for the present process is the appearance on the interior face of the deposit a complimentary replicate of the surface of the razor blade as shown in FIG. 8. The photomicrograph with the complementary replicate surface is shown in FIG. 9, and illustrates the unusual nature of the deposit in that the deposit replicates it seems in a one-to-one correspondence the topography of the razor blade. Thus, each of the crevices, fissures, and indentations in FIG. 8 illustration is first filled in and as seen from looking at the photomicrograph of FIG. 10 but is not replicated on the exterior (face) surface of the deposit.

To what extent bonding other than mechanical bonding between the stainless steel and diamond deposit takes place is not known, but the tenacity of the deposit is such that it surpasses based on my observation any known bond interface strength data I am personally aware such as an epoxy bead cured on the deposit with a stick into the bead. The deposit easily withstands the test. The stick breaks or the epoxy bead breaks. Consequently, a test such as ion milling, i.e., ion beam impingement and rate of removal of deposited species may be used for establishing adherence. These methods are well known in the art.

With the above photomicrograph illustrate the improved deposit over my previous work described in the above U.S. Patent, the quantitative and qualitative differences are most convincingly demonstratable when the device shown in the prior art is run at the conditions as specified in my prior patent. Such conditions even when practiced with the present improved fibrous transfer means 12 in the old process will not produce the high quality deposits achieved by the device of FIGS. 1 and 2 as tested by the measures disclosed herein. In comparison with chemical vapor deposition (CVD) which shows poor coherence, smoothness and adhesion, the present deposits are far and away superior. Likewise, plasma deposits similarly on a microscale show very granular structure, poor coherence and adherence to the substrate. Again when compared to present deposits, plasma deposits are vastly inferior.

While most of the comparative work has been carried out with the diamond particles, other work corroborates the diamond work. It can be demonstrated that the deposits of the present invention may be made with any of the very hard materials previously mentioned materials such as the nitrides including cubic boron nitride, silicon nitride, borides and the like of the nitride, carbide, oxides, arsenide, zirconide, phosphide and boride forming metals and metaloids, rare earth compounds and transition metals. Such are well known in the art (cf. U.S. Pat. Nos. 4,358,506, 4,396,677, 4,374,903, 4,376,806 and 4,426,423). It is emphasized, that in addition to the commonly known metals, and their nitride, carbide, boride and oxide forming elements, rare earth elements, which form the above compounds are also included within the group from which various deposits may be made on a suitable substrate.

In addition various forms of carbon may also be deposited in a tightly adhering deposit such as soot, graphite (if produced of sufficient angularity) carbon black from various sources, buckminister fullerenes (bucky balls) or tubular fullerenes (bucky tubes) of various other types including those in admixture with a dopant, metal-carbohedrenes (met-cars) catalytic or conductive quantities of metals or other elements sequestered in the fullerene or met-car molecule in various forms and in various proportions thereof (Cf. Cartier, *Production of Metallo Carbohedrenes in the Solid State*, Science, Volume 260,page 195, Apr. 9, 1993.

The various species of the material disclosed in the article, and in the references cited in the article are useable and are incorporated by references herein. To the extent to which the above references provide support for the extensive discussion of various suitable materials which may be used in the process herein, these disclosures are incorporated by reference herein. Such as the above United States patents and the mentioned articles.

Among the minerals found in nature those having a hardness based on a hardness of 1 to 10 scale (talc 1 and diamond 10), the minerals above 2 in hardness such as beryl $Be_3Al_2Si_6O_{18}$ at 8 are illustrative of deposits which may be made. Typically the desired group includes minerals of hardness above 3.0 and includes preferably minerals of hardness above 4.5. It is to be understood that special applications which require less hard minerals are within the contemplation of the present invention such as for specialized applications, e.g., light transmissive deposits on various lenses and glasses. In any event, the process is applicable, it seems, to all mineral compositions provided the melting of particles 47 are not encountered and if encountered cooling of fibrous transfer means 12 still allows a deposition.

Still further, the superconducting compounds such as of the Y—Ba—Cu—O Systems (cf. Brosha et al "Metastability of Superconducting Compounds in the Y—Ba—Cu—O System", Science, Volume 260, page 196 et seq., Apr. 9, 1993) illustrates the various species of the compounds and gives the background. These compounds are also listed in the reference cited at the end of the article.

Besides the above materials light transmission coatings such as ZnSe, NaF, NaCl, and the like may be deposited and thereafter protected by a desirable surface film such as diamond and the like are also included as being suitable for deposition on optical devices. Diamond capacitors, and diamond based resistance elements suitable for electronic industry and useful in wave guide circuits for electric properties are all contemplated.

Wear resistance improving applications are one of the applications to which this invention is directed such as diamond or cubic boron nitride deposits on tool steels, carbide or nitride tools and inserts for tools made from these materials. Similarly deposits on pump surfaces for abrasion resistance is now possible with diamond film.

As it is well known such as from Suh et. al., The Delamination Theory of Wear, Elsevier Sequoia S.A. Lausanne, 1977, e.g. on pages 232, 132 that quality coatings and the surface deposits require small particles and tight adhesion for wear minimization. The present deposits are admirably suitable for satisfying the conditions for wear improvement, i.e., the coatings are void free, may be made of adequate thickness, have outstanding deposit-substrate adhesion characteristics, outstanding surface topography (cf. FIG. 10 herein) and other sought after like characteristics. Consequently, wear surfaces such as cutting surfaces and abrasion resistant surfaces may be improved.

In view of the fact that the substrate on which the deposit is made is not affected in any substantial manner, it has become possible to make the novel deposits on metals, plastics, composites, glass, quartz, ceramics, cermets, mineral compositions and the like. Of the various substrates illustrated it is seen that such deposits are best made on substrates which are used in combination with the deposit such as for semiconductor devices. Likewise a substrate which may have intermediate layers are suitable as disclosed in the above article concerning superconducting YBCO compositions.

A fused combination of silicon dioxide and zirconium dioxide powder may be deposited on alumina or the substrates which are especially desirable. Other substrates are the high strength polymers such as polycarbonates, polyimides, polyacrylates, polysulfones, polyurethanes, epoxy polymers, polytetrafleuoro ethylenes and other halogen submitted polymers of that family, polyester polymers, recently made "alloys" of these polymers, etc. in various forms such as films, shapes, geometrical configurations and the like. On some of the hard to deposit polymers hard dye pigments may be deposited by the method of this invention. Likewise it has been possible to deposit some Of the above resins of improved properties over my prior work in my above patents. Thus, metal and metal free phthlocyanines and conductive polymers individually or in combination with various mixtures such as bis-benzimidazo (2,1-a-1',1'-b)anthra(2,1,9-def:6,5,10-d'e'f') diisoquinoline-6,11-dione and bis-benzimidazo-(2,1-a-1',1'-b) anthra(2,1,9-def:6,5,10-d'2'f')-diisoquinoline-10,2-dione.

Other base substrates may be nylons, polymethylenes, Delrin (TM of DuPont) and filled nylon and other polymer compositions; likewise these may also be deposited on another substrate e.g., aluminum or a ceramic.

Having thus described and characterized the present invention with reference to my prior work and in order to distinguish it from my prior work, to point out clearly and describe the invention for its enablement, for the reasonable variations and for the scope for the teachings found therein, the claimed invention is to be defined by the claims herein and all reasonable scope to which these claims are entitled.

What I claim is:

1. In a method for depositing a material on a substrate, the improvement comprising:

introducing onto a rapidly rotating fibrous transfer means dry particles of said material sought to be deposited wherein the rotational velocity for said fibrous transfer mean is from about 6,000 R.P.M. for about a 1 inch diameter fibrous transfer means to about 25,000 R.P.M. for about a 12 inch diameter fibrous transfer means;

transferring said dry particles within said fibrous transfer means onto said substrate;

dragging said particles within said transfer means across a work zone in retro-grade direction vis-a-vis said substrate at a pressure concomitant to said rotational velocity substantially insufficient to affect said fibrous transfer means and a surface of said substrate exposed to said particles but sufficient to deposit at least a portion of said dragged particles on said substrate in a close, tightly packed adherent and coherent deposit onto said substrate wherein an adherence of said deposit is greater, when measured by an ion milling method, for an identical material when said material is deposited by CVD or plasma deposition means.

2. The method as defined in claim 1, wherein said adherence of said deposit is tested by ion milling of a diamond deposit on a substrate wherein a precursor for said diamond deposit is diamond particles with a size between about 0–¾ micron.

3. The process as defined in claim 1, wherein said dry particles are selected from the group consisting of mineral, metal carbide and nitride, metalloid nitride and carbide, superconductor material, carbon, a carbon derivative, an oxide, an arsenide, a phosphide, a silicate, a calcite, a beryl, a ceramic, a cermet and mixtures of a foregoing wherein said particles have an angle of repose of at least 35° and are of a size of less than 10 microns mean average size and wherein said deposit from said particles is of a dense, closely packed tightly adhering deposit of improved adhesion and/or cohesion and surface smoothness when compared to the same material when deposited by a CVD or a plasma process.

4. The process as defined in claim 3, wherein the particles are angular and have an angle of repose of at least 45° and wherein the particles have a size of about 1 micron and a hardness for the material at least about 4.5 based on a hardness, scale of for talc and 10 for diamond.

5. The method as defined in claim 1, wherein hardness of the material is from 4.5 to 10 based on a hardness scale of 1 for talc and for diamond and the hardness in the deposit substantially replicates a continuous film of the material of a hardness found for a non-deposited material crystal microscopically tested for the hardness.

6. In a continuous process depositing a diamond deposit on a substrate selected from the group consisting of metals, carbides, nitrides, ceramics, glass and polymers, wherein said diamond deposit is of adherence improved as compared to a CVD deposit as measured by ion beam milling for adherence for the CVD deposit, the improvement comprising: introducing diamond particles with a size between 0 to 1 micron, onto a rapidly rotating fibers transfer means rotating at a rotational velocity of from about 6,000 R.P.M. for about 1 inch diameter fibrous transfer means to about 25,000 R.P.M. for about a 12 inch diameter fibrous transfer means, wherein fibers in said fibrous transfer means are selected from at least one member of the group consisting of silk, wool, polyimides, polyaramids, animal and human hair, cotton and linen, wherein the finess of fibers is at least that of finest wool and wherein said fibrous transfer means has a fiber length of at least 1 inch;

exposing only so much of particles enmeshed in said fibrous transfer means to said substrate on which a deposit is sought to be deposited so as to enable said fibers to drag a succession of said diamond particles in a retrograde manner vis-a-vis said substrate comprised of a surface on which said deposit is to be deposited and so as to obtain an initial deposit;

preselecting a lower rotational velocity for said fibrous transfer means and a pressure corresponding thereto for additional particle deposition on said substrate as a coherent, adherent, fully integral deposit structure;

building up such deposit to a preselected thickness; and recovering said substrate.

* * * * *